United States Patent [19]

Cheng

[11] Patent Number: 5,044,560

[45] Date of Patent: Sep. 3, 1991

[54] NOZZLE HEAD FOR LIQUID SPRAY

[76] Inventor: Yap Y. Cheng, Syarikat Jun Chong Sdn Bhd, 18 Jalan Lambak, 86000 Kluang, Johor, Malaysia

[21] Appl. No.: 388,584

[22] Filed: Aug. 1, 1989

[51] Int. Cl.[5] ..... B05B 1/34; B05B 1/18

[52] U.S. Cl. ..... 239/476; 239/490; 239/492; 239/497

[58] Field of Search ..... 239/476, 490, 491, 492, 239/494, 496, 497

[56] References Cited

U.S. PATENT DOCUMENTS 604,873 5/1898 Bean ..... 239/494 X
935,124 9/1909 Myers ..... 239/497 X
2,250,079 7/1941 McDonald ..... 239/496
4,109,869 8/1978 Brockelsby et al. ..... 239/491

FOREIGN PATENT DOCUMENTS 144237 11/1951 Australia ..... 239/497

*Primary Examiner*—Andres Kashnikow
*Assistant Examiner*—William Grant
*Attorney, Agent, or Firm*—Wilian Brinks Olds Hofer Gilson & Lione

[57] ABSTRACT

The invention describes a nozzle head for effectuating a broad angle cone of spray of liquid which liquid is contained in a tank and is forced into the nozzle head by pressure applied to the liquid contained in the tank.

1 Claim, 2 Drawing Sheets

NOZZLE HEAD FOR LIQUID SPRAY

This invention relates to a means for effecting the spray of a liquid from a tank and pump means, and more particularly to means for increasing the area of spread of a liquid spray from a nozzle head fastened to a tank and pump means. Such a nozzle head attached to a tank and pump means is intended to reduce the distance between the nozzle head and the receiving area.

The nozzle heads presently available on the market are fastened to a tank and pump means by means of a connecting pipe or hose. To operate such equipment, the tank is filled with liquid and the contents are subsequently subjected to an increase in atmospheric pressure, usually by means of activating the pump means. The contents of the tank being subjected to increased atmospheric pressure, is forced out through the nozzle head. The nozzle head typically comprises a drum with one open end. The other end accommodates a hollow cylindrical shaft in a sealingly engageable manner. The said hollow cylindrical shaft is cooperably movable along the longitudinal axis of the said cylindrical body. The terminal end of the shaft inside the drum is fastened to a flange which is sealingly engageable and movable along the said longitudinal axis, thereby altering the spacious volume between the flange and the nozzle cover.

The open end of the drum is typically demountably and sealingly fastened to a planer cover; the said cover includes at least one orifice. The said cover is of two portions, the first portion is a cylindrical and of sufficient thickness so as to enable the portion to be sealingly engageable to the open end of the drum; and the second portion is usually of larger/equal diameter to the drum to facilitate the mounting of the cover onto the drum.

To have a spray effect of the liquid, the presently available nozzle include the following configuration or features. The nozzle cover includes at least one chamber terminating in an orifice and the said chamber communicating to a central chamber by means of a duct, whose width is substantially equal to the diameter of the orifice. The said duct is positioned tangentically to the central chamber. The said central chamber is axially placed in registration with the terminal opening of the shaft hereinbefore described, and the diameter of the central chamber is marginally smaller than the diameter of the said terminal opening. Further, the said central chamber does not include any orifice connecting the chamber to the outside. Typically the central chamber is connected to a plurality of secondary chambers with orifices.

The above described nozzle heads currently available in the market suffer from a number of disadvantages. The secondary chamber is of two portions. The first portion is fructo-conical whose apex terminates in an orific connecting the chamber to the outside; and the second portion is cylindrical with a connecting duct to the central chamber. The height of the secondary chamber comprising of the fructo-cone and the cylinder equals the thickness of the nozzle cover. In some embodiments, the secondary chamber consists only of one fructo-conical portion and whose height equals the thickness of the nozzle cover. The liquid from the drum is introduced into the central chamber from where the liquid is subsequently introduced into the secondary chamber via the connecting duct. The said liquid at pressure is ejected out of the nozzle via the orifice in a spray form. The angle at the vertex of the cone of spray is a function of the height of the chamber.

The size of the angle of spray cone is inversely proportional to the height of the chamber and to the distance of the flange from the nozzle cover. Thus, the angle of spray cone is relatively small when the height of the secondary chamber is relatively large and conversely the angle of the spray cone is large when the said height is relatively small. Thus, it is advantageous to reduce the height of the secondary chamber to facilitate a wide angle of spray cone. Further, angle of spray is increased as the distance between the flange and the nozzle cover is reduced. Optimally the flange should be in close contact with the nozzle cover.

In the presently available nozzle covers, the height of the secondary chamber equals the total thickness of the nozzle cover. The problem has been how to reduce the height of the secondary chamber without in any way limiting the mountability of the nozzle cover onto the open end of the drum.

It is an object of the present invention to provide a new and improved sealingly mountable nozzle cover to facilitate the ejection of the liquid from the container tank in a wide angle spray cone.

It is another object of the present invention to provide such a nozzle cover, which when employed in nozzle heads facilitates the ejection of the liquid from the container tank in a wide angle spray cone.

The invention accordingly provides a nozzle head for liquid spray which comprises drum body and a sealingly mountable nozzle cover; wherein the drum body includes a hollow cylindrical shaft cooperably movable along the longitudinal axis and a flange fastened to the terminal end of the shaft inside the said drum body sealingly engageable and movable along the said longitudinal axis. The said flange includes an aperture coaxially placed. The nozzle cover includes a first portion capable of being sealingly mountable onto the open end of the said drum body, and the said first portion includes a primary chamber in registration with the open end of the shaft and the central axis of the said flange, and the diameter of the primary chamber is marginally smaller than the diameter of the aperture (open end of the shaft). The nozzle cover further includes at least one secondary chamber which is fructo-conical in cross-section and whose vertex terminates in an orifice extending to the external environment; the said primary chamber connected to the said secondary chamber via a communication duct. The diameter of the orifice is substantially smaller than the width of the duct (optimally in the ratio 1:3). The said duct connects the primary and secondary chamber in a tangentical position in relation to both chambers. Advantageously the nozzle cover also includes an annular ring preferably integrally connected to the external edge of the said first portion and whose outer perimeter surface is serrated and/or grooved to provide a non-slip surface. Preferrably the inner side of the annular ring on the external surface is cut at an inclination to the first portion to prevent the obstruction of the spray.

The nozzle cover preferably includes a plurality of secondary chambers, each connected to the said central chamber via a communicating duct as described earlier.

The invention will now be further described by way of example only, with reference to the accompanying drawings, in which.

Figure 5:
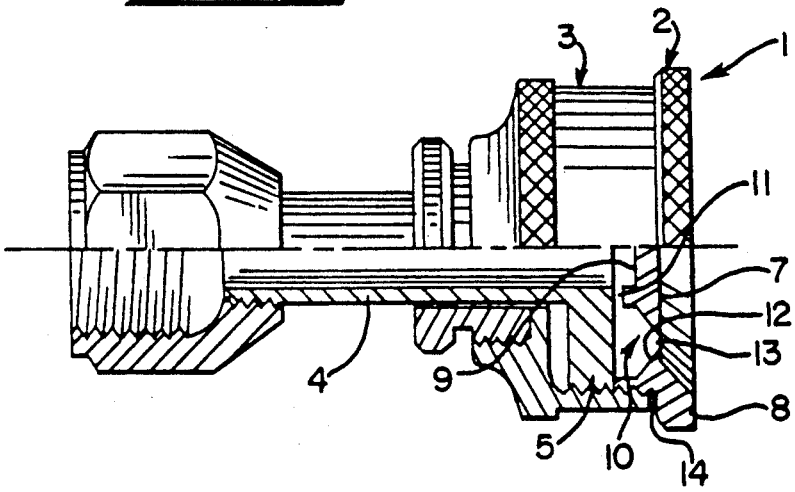
FIG. 5 is a cut-out view showing nozzle cover in position in nozzle head and diagrammatical representing the flow of liquid inside the nozzle head.

The illustrated nozzle (1) includes a nozzle cover (2) sealingly mounted onto to a nozzle drum body (3). The drum body (3) further includes a hollow shaft (4), the terminal end of which is fastened to a flange (5). The flange (5) is sealingly engageable and movable along the longitudinal axis preferably by screw means. Accordingly, the inner circumferential side of the drum body (3) has corresponding thread to accommodate the flange (5) (FIG. 5).

Figure 1C:
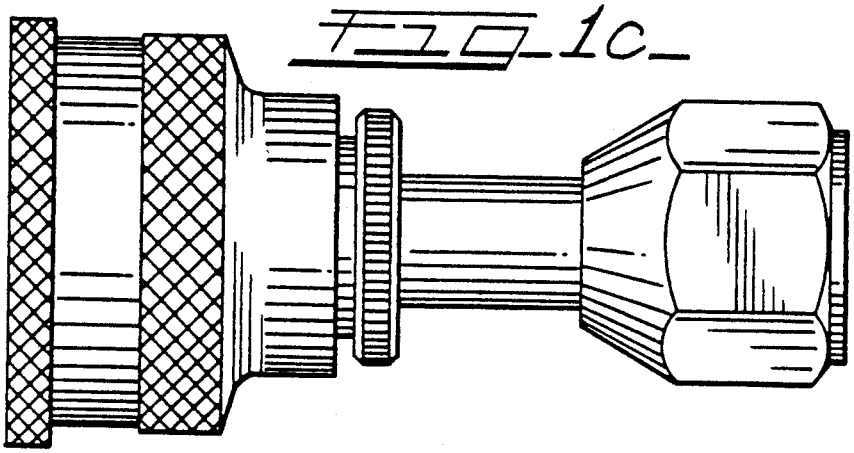
FIGS. 1a–1c illustrate perspective views of a nozzle head.
Figure 1A:
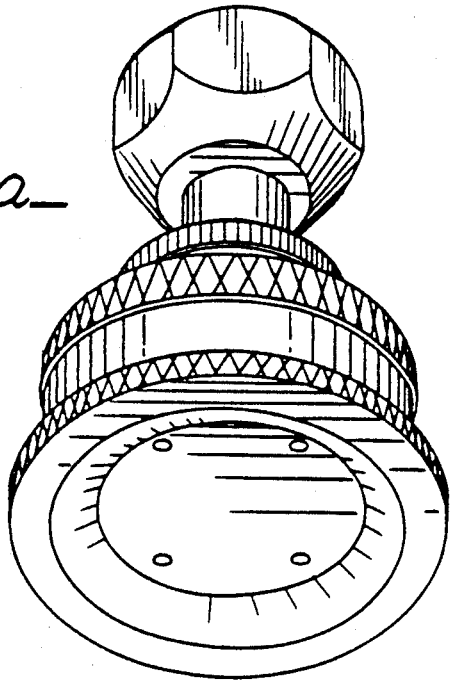
Figure 1B:
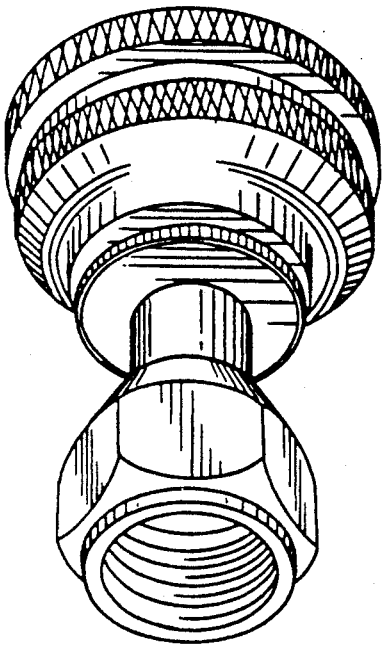
Figure 2:
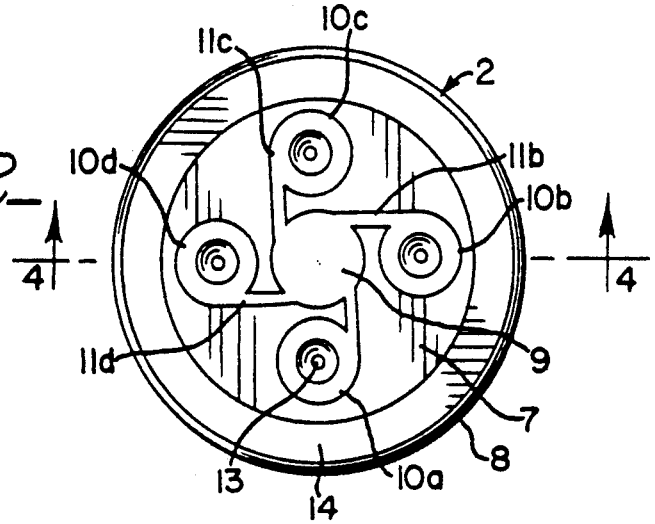
FIG. 2 is a plan view of the inside surface of the nozzle corresponding to the invention.
Figure 3:
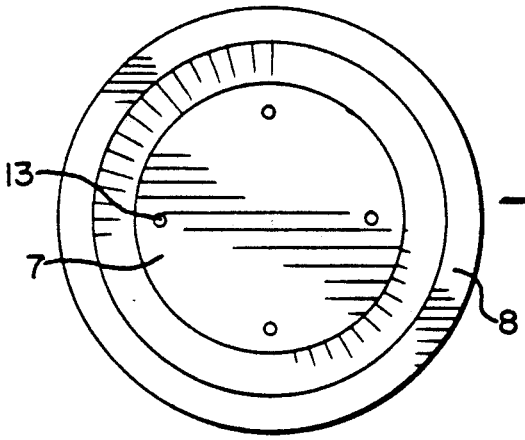
FIG. 3 is a plan view of the outside surface of the nozzle cover.
Figure 4:
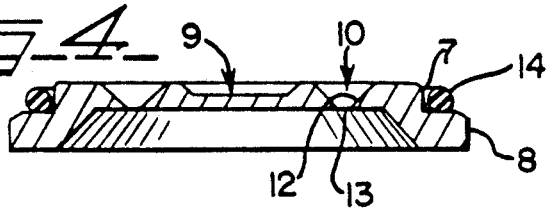
FIG. 4 is a cross-section view of the nozzle cover along line 4—4 in FIG. 2.

The nozzle cover (2) is advantageously of two portions (7, 8). The first portion (7) is sealingly mountable onto the open end of the drum body (3). It is a preferred embodiment of the present invention that the circumferential edge of the first portion includes threads to cooperate with the threads in the inner circumferential surface of the drum body. This facilitates the mounting of the nozzle cover (2) onto the nozzle drum body (3) in a sealing manner. The said first portion (7) includes a primary chamber (9), positioned co-axially with the open end of the shaft (4). The diameter of the primary chamber is marginally smaller than the diameter of the open end of shaft. The first portion (7) further includes at least one other secondary chamber (10). It is another preferred embodiment of the present invention that first portion (7) includes a plurality of secondary chambers positioned symmetrically to the outside of the primary chamber (9) (FIG. 2). The secondary chambers (10*a, b, c, d*) communicate to the primary chamber (9) via connecting ducts (11*a, b, c, d*). The said duct is positioned tangentically to both the primary and secondary chambers (FIG. 2). The width of the communicating duct (11) is preferably larger than the diameter of the orifice opening (13). It is a preferred embodiment of the present invention that the width of the said duct and the diameter of the orifice opening be in the ratio 3:1.

The secondary chamber (10) includes a fructo-conical chamber (12), the vertex of which chamber terminates in an orifice (13). The height of the secondary chamber (10) is equal to the thickness of the first portion (7). It is to be understood that the height of the secondary chamber is function of the thickness of the first portion. As will described hereafter, the said height must be kept to an optimum dimension to achieve the desired objectives of the invention.

The nozzle cover (2) advantageously includes a second portion (8) which is integrally connected to the first portion (7) to form an annular ring. The circumferential edge of the portion (8) is preferably grooved or serrated to provide a slip resistant surface. Advantageously a sealing ring washer (14) can be mounted onto the internal surface of the second portion to facilitate a leakproof mounting.

In the present invention, the thickness of the first portion is approximately one half of the total thickness of the nozzle cover, thereby substantially reducing the height of the secondary chamber as compared to the height of such chambers in conventional nozzle covers.

The flow of liquid during the operation of the nozzle head will now be described. The liquid is introduced into the drum body of the nozzle head from the pressurized tank holding the liquid. Typically the tank body is connected to the nozzle head by means of a flexible tube. The liquid travels through the hollow shaft (4) through force of pressure to the primary chamber (9) from where it travels into the secondary chamber (10) via the connecting duct (11). The travel of the liquid from the primary chamber to the secondary chamber via the said duct creates a churning effect in the liquid contained in the secondary chamber (10). The liquid is ejected out through the orifice (13) in a conical spray. The vertex angle of the spray ($\alpha$) is a function of the height of the secondary chamber. In the present invention, the said height is smaller than in presently available nozzles. Accordingly, the angle of the vertex of the spray cone ($\alpha$) is substantially broader than in conventional nozzles. The angle is largest when the planar surface of the flange is in contact with surface of the first portion (7) of the nozzle cover (2) at a given pressure. In this operating position, the liquid from the shaft (4) directly impinges on the primary chamber and is directly ejected into the secondary chamber in a tangential direction, thereby creating a churning effect. As the liquid is introduced into the nozzle head at substantially above atmospheric pressures, the liquid contained in the secondary chamber (10) is ejected out through the orifice (13) in a conical spray.

It is to be understood that for a given orifice size, the angle of spray ($\alpha$) is a function of the pressure applied on the liquid. Accordingly, the pressure can be reduced by moving the flange (5) away from the nozzle cover, thereby reducing the angle spray ($\alpha$). Conversely to increase the angle of spray ($\alpha$) the flange is moved forward in the direction of the nozzle cover. The angle ($\alpha$) is widest when the flange is in contact with the nozzle cover. In this operating position, all the liquid in the shaft is ejected into the primary chamber. All the said liquid is subsequently forced into the secondary chambers via the communicating ducts. As the width of the ducts is substantially larger than the diameter of the orifice, larger volume of the liquid enters the chamber, thereby ejecting the liquid in the chamber via the orifice at a pressure. The liquid leaves the chamber in a spray form.

I claim:

1. A nozzle cover for providing a large angle of liquid spray comprising:

a drum body having a hollow cylindrical shaft coaxially movable along a longitudinal axis of said drum body, a flange fastened to the terminal end of said shaft inside said drum body, said flange having a coaxial aperture and being sealingly engageable and coaxially movable along said longitudinal axis of said drum body;

a first portion mountable onto an open end of said drum body, said first portion having a primary cavity in registration with said shaft and connected via a communication duct to at least one secondary cavity, said communication duct being positioned tangentially in relation to said primary and secondary cavities, each of said at least one secondary cavity having an orifice leading to the outside atmosphere at one end and further having an opposite end, said first portion having a thickness such that the distance from said opposite end of said orifice to said one end of said orifice comprises said thickness of said first portion, and said communication duct having a width measured perpendicular to the direction of liquid flow through said communication duct, said width of said communication duct being substantially larger than the diameter of said orifice; and a second portion attached to said first portion, said second portion having an outer edge and a planar surface through which said orifice passes, said planar surface being depressed from said outer edge such that said thickness of said first portion is less than the distance from said opposite end to said outer edge;

whereby, liquid that is pumped under pressure through said drum body into said primary cavity passes through said communication duct to said secondary cavity, and is ejected through said orifice into the outside atmosphere in a large angle of spray.

* * * * *